US006164607A

United States Patent [19]

Hawkes

[11] Patent Number: 6,164,607

[45] Date of Patent: Dec. 26, 2000

[54] ADJUSTABLE PORTABLE BAG HOLDER

[76] Inventor: Benjamin W. Hawkes, 2414 Sandy Ct., Kernersville, N.C. 27284

[21] Appl. No.: 09/039,187

[22] Filed: Mar. 16, 1998

Related U.S. Application Data

[60] Provisional application No. 60/050,834, Jun. 26, 1997.

[51] Int. Cl.[7] ..... A63B 55/04

[52] U.S. Cl. ..... 248/97; 248/99; 248/150; 141/391

[58] Field of Search ..... 248/95, 97–101, 248/125.1, 125.3, 188.5, 150, 165, 407; 141/390, 391, 316; 224/539, 925; 211/182

[56] References Cited

U.S. PATENT DOCUMENTS

| | | | |
|---|---|---|---|
| 942,231 | 12/1909 | Woodman | 248/97 |
| 4,196,880 | 4/1980 | Hynes | 248/99 |
| 4,202,521 | 5/1980 | Harding | 248/98 |
| 4,684,087 | 8/1987 | Spickard | 248/97 |
| 4,759,519 | 7/1988 | Cheng | 248/99 |
| 4,783,031 | 11/1988 | Ebentheuer | 248/97 |
| 4,856,740 | 8/1989 | MacLeod et al. | 248/97 |
| 4,957,252 | 9/1990 | Watkins | 248/97 |
| 5,107,775 | 4/1992 | Langlais et al. | 108/144 |
| 5,180,126 | 1/1993 | Bennett | 248/99 |
| 5,222,536 | 6/1993 | Hodgdon | 141/390 |
| 5,522,642 | 6/1996 | Herzog | 297/344.18 |

FOREIGN PATENT DOCUMENTS

| | | |
|---|---|---|
| 390538 | 4/1933 | United Kingdom . |
| 2150538 | 7/1985 | United Kingdom . |

*Primary Examiner*—Anita M. King
*Assistant Examiner*—Gwendolyn Baxter
*Attorney, Agent, or Firm*—Richard C. Litman

[57] ABSTRACT

A portable and adjustable bag holder having an adjustable frame, a plurality of legs perpendicularly attached to the frame and a plurality of feet slidably adjustable within the legs. The frame has two U-shaped arms, each of which has two free ends. One of the arms is hollow at the free ends to accept the other arm so that the other arm can telescopingly slide within the first arm's cavity. The first arm has a knob acting as a detent and located within the cavity. The second arm has a plurality of notches which engage the knob as the second arm slidably moves within the first arm. The engagement of the knob and notch keeps the two arms temporarily fixed in place. In an alternative embodiment, the ends of the two arms are made removable and replaceable in order to expand or contract the range of adjustment of the frame to accommodate bags having circumferences which vary greatly. The bag holder also adjusts in height to accommodate bags of various heights. This is accomplished by sliding the feet within the legs and placing a pin within holes cut into the legs and feet. The pin keeps the legs and feet in a locked position.

8 Claims, 6 Drawing Sheets

ADJUSTABLE PORTABLE BAG HOLDER

CROSS-REFERENCE TO RELATED APPLICATION

This application claims the benefit of U.S. Provisional Patent Application Serial No. 60/050,834, filed Jun. 26, 1997.

BACKGROUND OF THE INVENTION

1. Field of the Invention

The present invention relates to a device for holding bags, such as trash bags. In particular, the invention relates to an adjustable portable bag holder.

2. Description of Related Art

Bags come in various sizes; so do receptacles for holding bags and other flexible containers usually made of plastic or paper. The typical areas of bag variability are in the circumference or width of the bag's opening or in the height of the bag from its closed end to the open end. It is often frustrating when one has a bag either too small or too big for the user's particular receptacle. Thus, there is a need for an adjustable holder that adjusts for differing bag sizes.

Adjustable bag holders are known in the prior art. For example, U.S. Pat. No. 4,196,880, issued Apr. 8, 1980 to Frederick B. W. Hynes shows a bag holder with opposing U-shaped tubes. A first tube has two figure-8 shaped sleeves fixedly attached to the tubes' free ends. The second tube slides into the free sleeve of the figure-8 sleeve. The user slidably adjusts the '880 device by moving the second tube to the desired opening. The Hynes holder fixedly attaches to a wall or some other vertical planar surface. The problem with this device is that it doesn't provide for adjustability along a bag's height. Also, the device is not portable.

Another bag holder is shown in U.S. Pat. No. 5,222,536, issued Jun. 29, 1993 to Marion Y. Hodgdon and Henn Oona. The '536 holder includes an open, peripheral frame having a collection tray hinged thereto, and a pair of expander arms that extend rearwardly from the frame and into a plastic trash bag to hold the bag open. The problem with this device is that the expander arms are inserted into the bag. This contaminates the arms with refuse.

U.S. Pat. No. 4,957,252, issued Sep. 18, 1990 to Vancil W. Watkins shows a support for plastic bags having handles. The Watkins support has a rectangular base, a pair of vertical members rigidly upward-standing from the base and a bag retainer supported by the vertical members parallel to and spaced from the base. This device only provides for support; it does not adjust for a bag's height or width.

Other bag holders are described in the following patents or applications: U.S. Pat. No. 4,202,521, issued May 13, 1980 to Frank M. Harding (Combination bag holder and dolly); U.S. Pat. No. 4,759,519, issued Jul. 26, 1988 to Wen H. Cheng (Garbage collection auxiliary apparatus); U.S. Pat. No. 4,856,740, issued Aug. 15, 1989 to Edwin A. MacLeod and E. Wesley Frank (Multi-purpose indoor/outdoor refuse bag support); U.S. Pat. No. 5,180,126, issued Jan. 19, 1993 to Charles 0. Bennett (Leaf caddy); U.K. Pat. No. 390,538, completed Apr. 13, 1933 by Frederick Spence (Improved means for holding bags or sacks open during filling); and U.K. Pat. App. GB 2,150,538 A, filed Nov. 16, 1984 by Flomat Limited and invented by Barrie A. Poulton (Discharging bulk containers).

None of the above inventions and patents, taken either singly or in combination, is seen to describe the instant invention as claimed.

SUMMARY OF THE INVENTION

The present invention is an adjustable portable bag holder. The bag holder has a frame, a plurality of legs, and a plurality of feet. The frame adjusts to the circumference or width of the bag. The bag holder also adjusts according to the height of a bag.

The adjustable frame is made of a first U-shaped arm with two free ends and a second U-shaped arm with two free ends. The first arm is hollow at each of the two free ends defining an internal diameter. The first arm is slightly larger in internal diameter than the external diameter of the second arm so that the second arm can be inserted and telescoped within the cavity of the first arm.

The second arm has a plurality of notches longitudinally positioned at the second arm's free ends. The first arm has a detent or knob on the interior portion of that arm. As the second arm is inserted into the first arm, a notch engages the detent or knob, holding the two arms in a temporarily fixed position.

In an alternative embodiment, the functionality of the bag holder is expanded by making the ends of the first and second arms removable and replaceable. Hence, the range of adjustment of the frame may be expanded or contracted to accommodate bags of all sizes.

The plurality of legs extend substantially perpendicularly down from one side of the frame. The legs are also hollow having a predetermined internal diameter and a pair of opposing holes passing through the end furthest away from the frame. A plurality of feet, which are preferably U-shaped having two free ends, telescopingly insert into the hollow of two legs. Longitudinally positioned along the free ends of a foot are a plurality of holes. As the free ends of a foot slide within the legs, the holes on a foot and the legs can be brought into registry. A pin is inserted into the registered holes to keep the foot and legs in a locked position.

To use the bag holder, a user inserts a bag into the frame. The open end of the bag is overlapped around the frame. The user pulls the frame apart until the bag is taut around the frame. In order to adjust for the bag's height, the user slides the foot up or down the legs, and inserts the pins in the appropriately registered holes.

Accordingly, it is a principal object of the invention to provide a bag holder which adjusts to bags of differing circumferences or widths.

It is another object of the invention to provide a bag holder which adjusts to the differing heights of bags.

Still another object of the invention is to provide a lightweight bag holder which is sturdy and portable.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
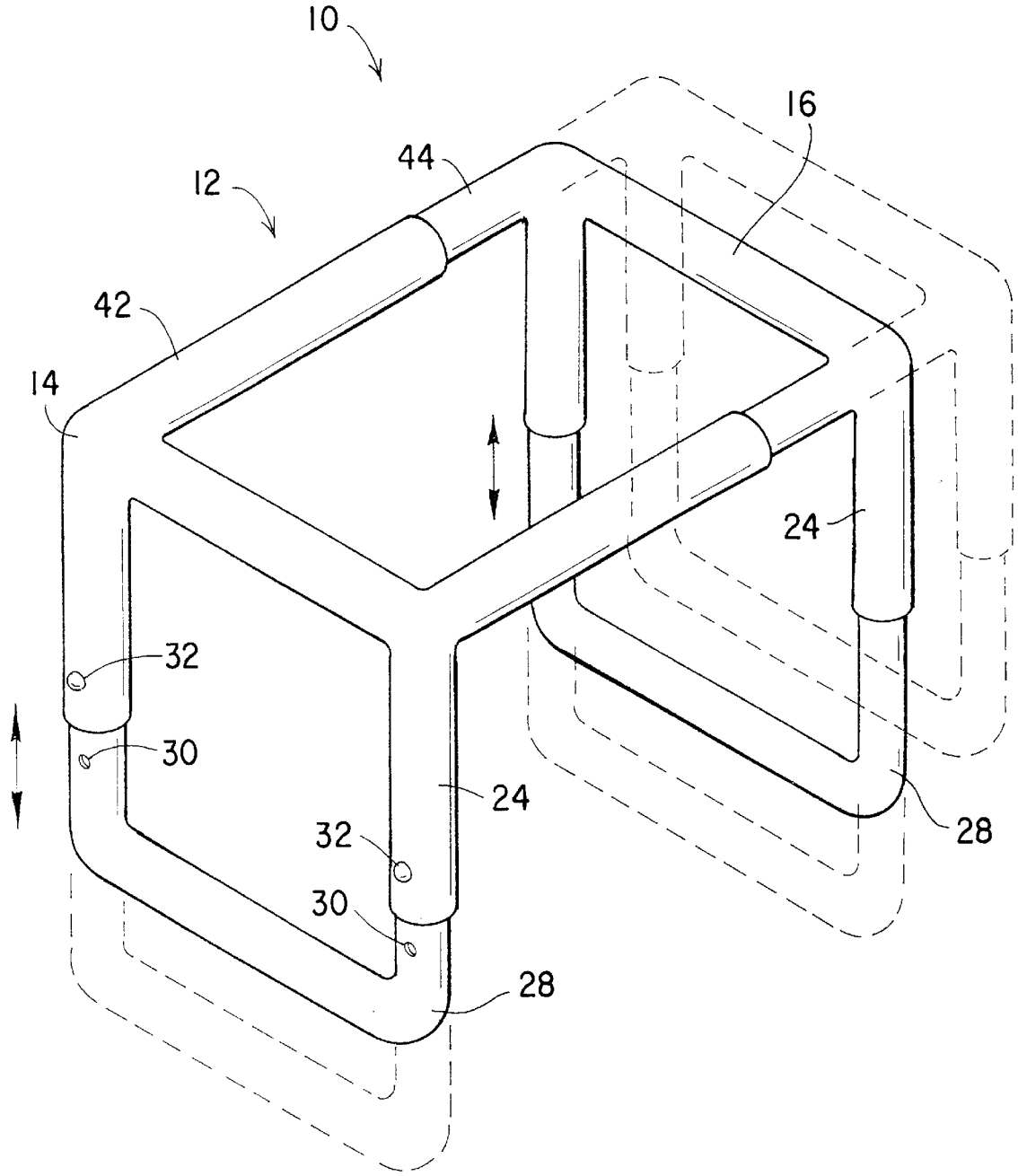
FIG. 1 is a perspective view of the bag holder with broken lines representing the reciprocating action of the base, legs and holder.
Figure 2A:
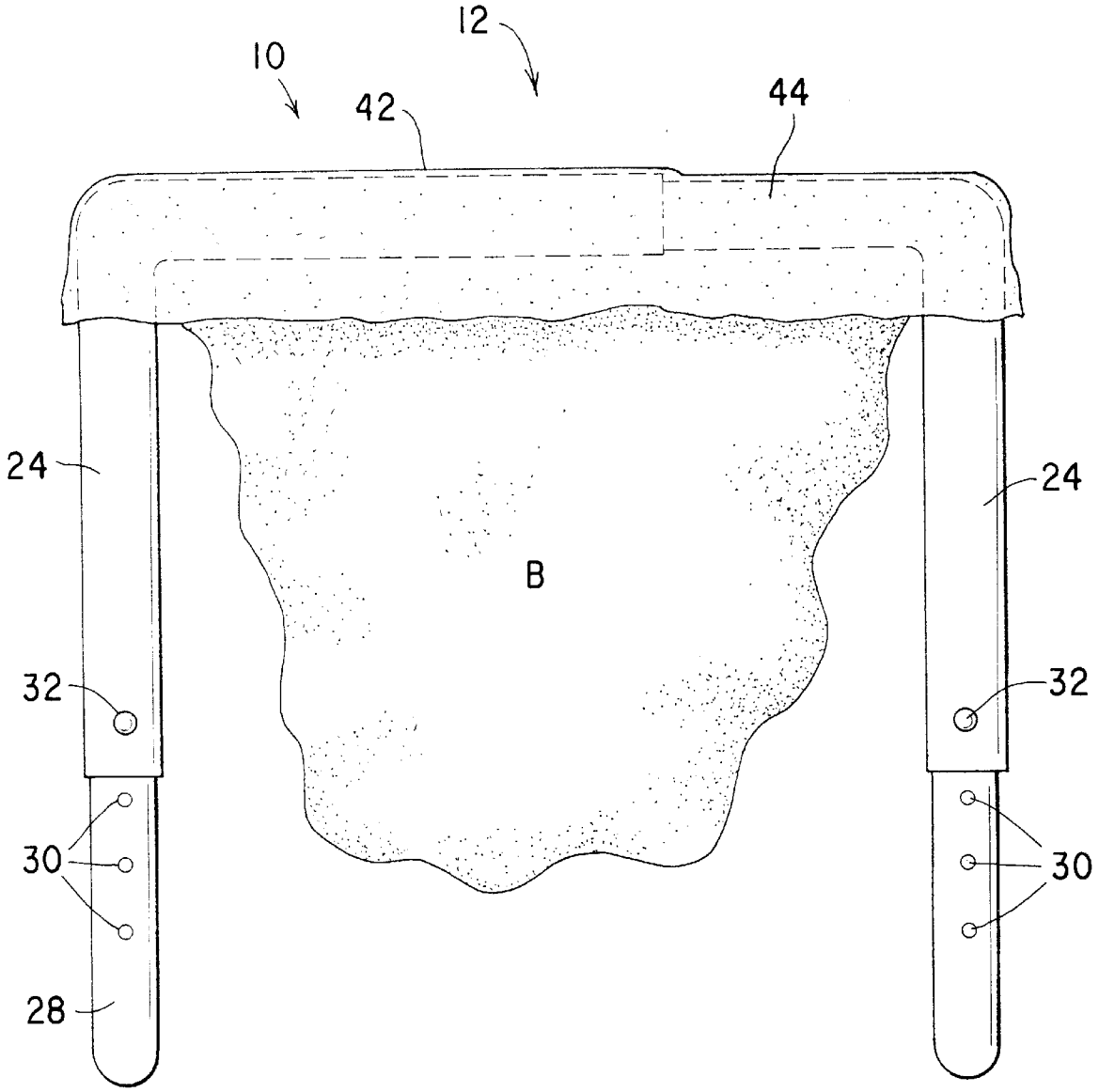
FIG. 2A is an environmental side view of the bag holder with a loose bag draped around the holder.
Figure 2B:
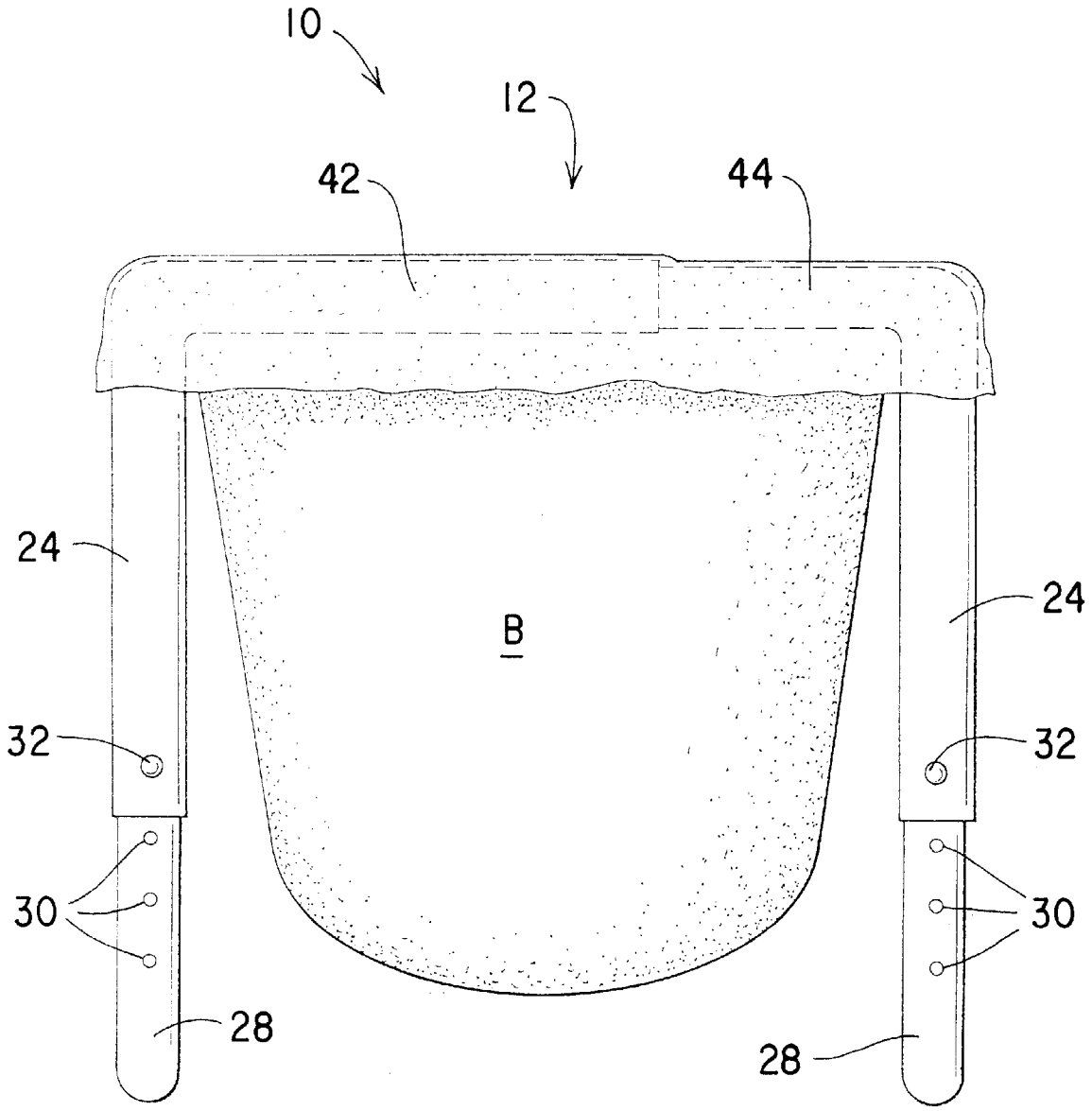
FIG. 2B is an environmental side view of the bag holder with a taut bag draped around the holder.
Figure 3:
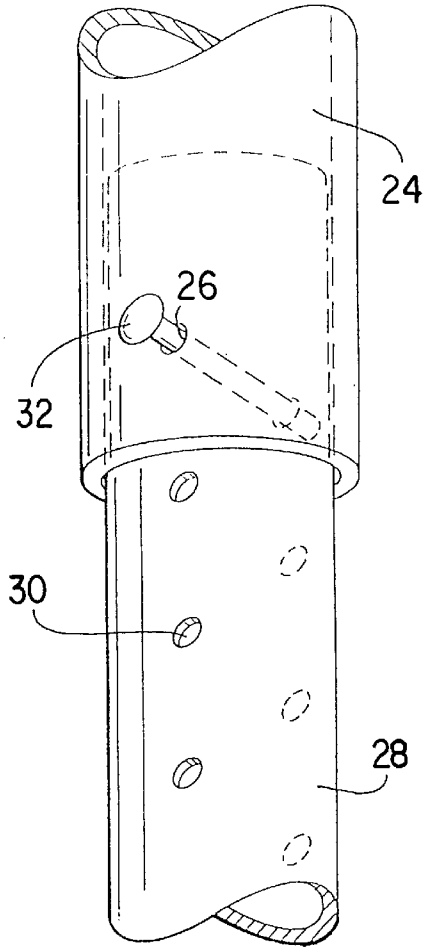
FIG. 3 is a close-up perspective side view depicting the holes and pin of the base and holder.

The present invention relates to a bag holder, specifically one that is portable and adjustable. The adjustable portable bag holder 10 has a frame 12, a plurality of legs 24 and a plurality of feet 28. The frame 12 is adjustable in order to conform to a bag's B width or circumference. The legs 24 and feet 28 adjustably couple together in order to conform to a bag's B height.

The frame 12 has a first arm 14 and a second arm 16. Both arms 14, 16 are generally U-shaped and have two free ends and a cavity defined therein. Each arm 14 and 16 has end members 42 and 44, respectively, at their two free ends, each end member 42 and 44 having a cavity defined therein. In the embodiment shown in FIGS. 1 through 4, the end members 42 and 44 are integral with the arms 14 and 16. The cavity defined in the end members 42 of the first arm 14 has an internal diameter which is slightly larger than the external diameter of the end members 44 of the second arm 16. Therefore, when the end members 44 of the second arm 16 are inserted into the cavities of the end members 42 of the first arm 14, the second arm 16 telescopes into the first arm 14.

Figure 4:
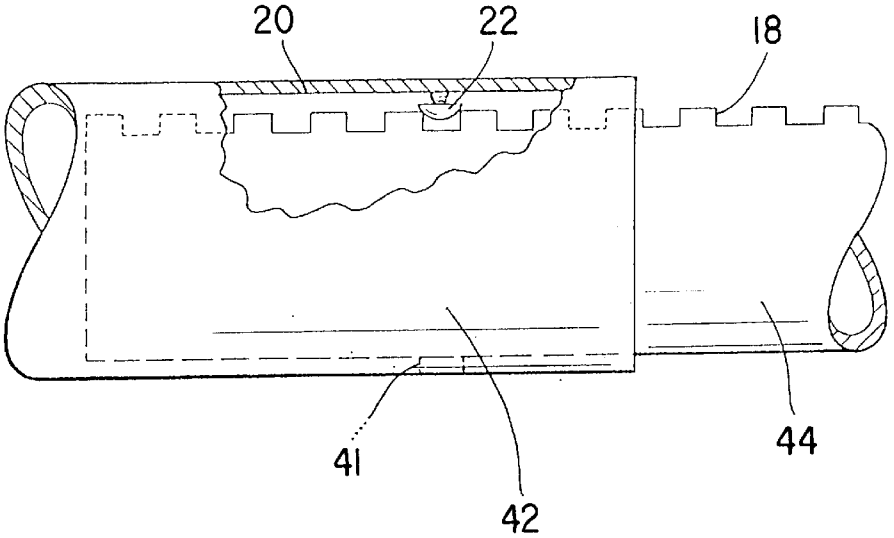
FIG. 4 is a close-up and cutaway side view of the end members of an arm.

As seen in FIG. 4 in detail, the end members 44 of the second arm 16 have a plurality of longitudinally arranged notches 18. The notches 18 are serially spaced along one side of the end members 44 of the second arm 16. The interior surface 20 of each of the end members 42 of the first arm 14 has a knob 22, serving as a detent which, as the end members 44 of the second arm 16 slide within the end members 42 of the first arm 14, engages one notch 18. This engagement temporarily holds the first arm 14 and the second arm 16 together in a fixed position. In order to disengage the arms 14 and 16, the user simply applies an outward force on either of the arms 14 or 16 and pulls them apart. It is preferred that the knob 22 is rounded to facilitate ease of engagement and disengagement, and may simply be a screw driven into the interior of a cavity of the end members 42, permitted to be driven through hole 41 by a screwdriver.

The assembled frame 12 is raised over the ground in a plane passing through all arms 42,44, which is substantially coplanar and parallel to the ground, by means of the plurality of legs 24 which are fixedly attached substantially perpendicular to the first arm 14 and the second arm 16. When the frame 12 is assembled, the legs 24 are substantially perpendicular to one side of the plane defined by the frame 12. At the end of the legs 24 not attached to the frame 12, the legs 24 have a cavity defining an internal diameter. A plurality of feet 28 insert into this cavity of the legs 24. The feet 28 are preferably U-shaped having two free ends each of which have an external diameter sized to be matingly received into a cavity, thus permitting a telescoping arrangement.

To fix the telescoped legs in position, the legs 24 have a pair of opposing holes 26 located near the free end of the legs 24. The feet 28 have a plurality of holes 30 running longitudinally along the free ends. As a foot 28 slides within a leg 24, the opposing holes 26 of a leg 24 align in registry with a hole 30 on the free ends of a foot 28. A pair of pins 32 are inserted into the lined up holes 26, 30 thereby fixing the legs 24 and feet 28 in a locked position.

Figure 5:
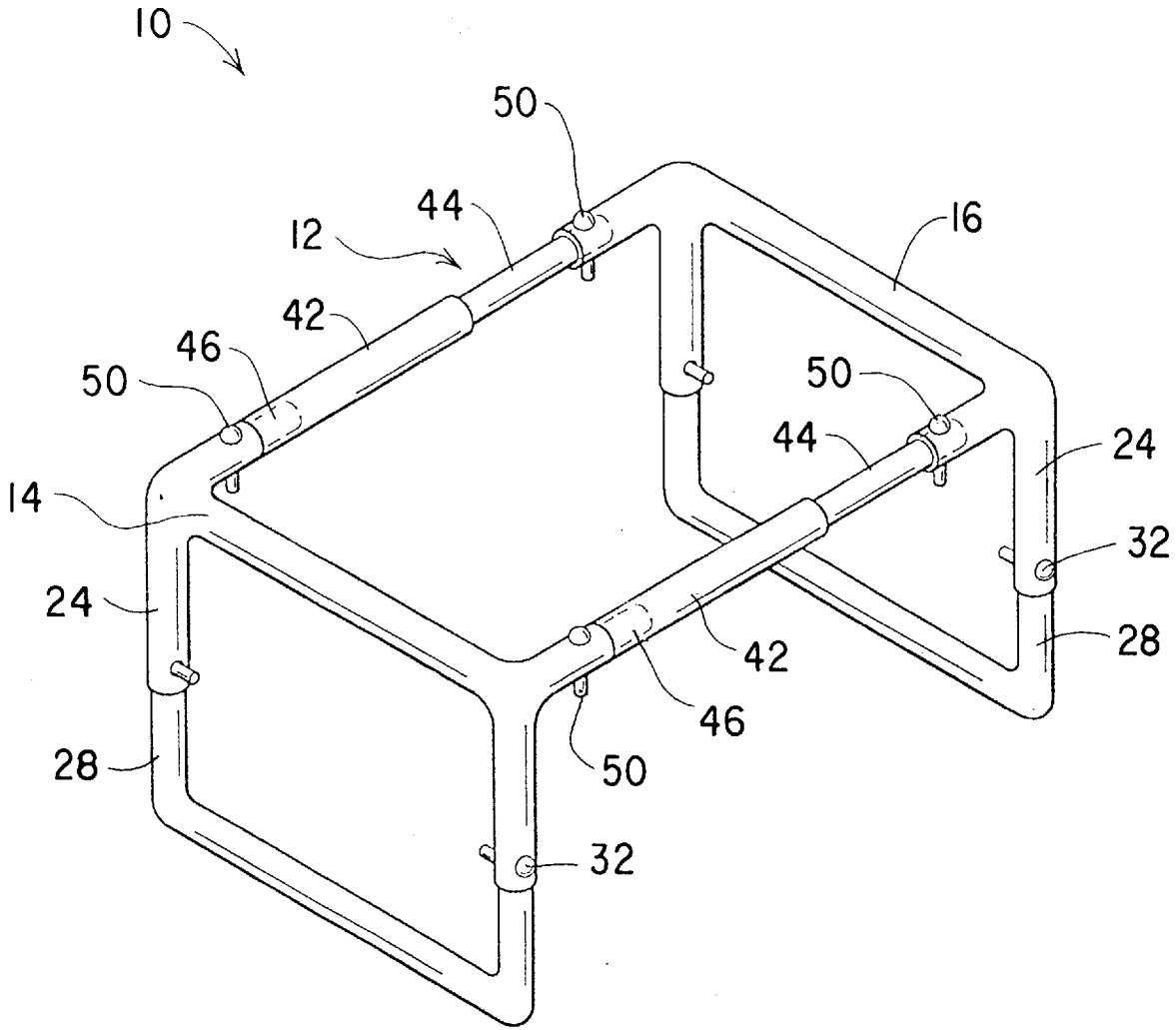
FIG. 5 is a top perspective view of an alternative embodiment of the bag holder.

It is apparent that bag holder can accommodate only those bags whose circumference falls within the range of adjustment of the frame 12. In order to extend or contract this range of adjustment, an alternative embodiment of the invention, as shown in FIG. 5, provides removable end members 42 and 44 which may be replaced by one of a range of longer or shorter end members. The bag holder may then accommodate bags ranging in size from small trash bags to extra large trash bags simply by removing and replacing the end member combination 42 and 44 with a shorter or longer combination.

Figure 6:
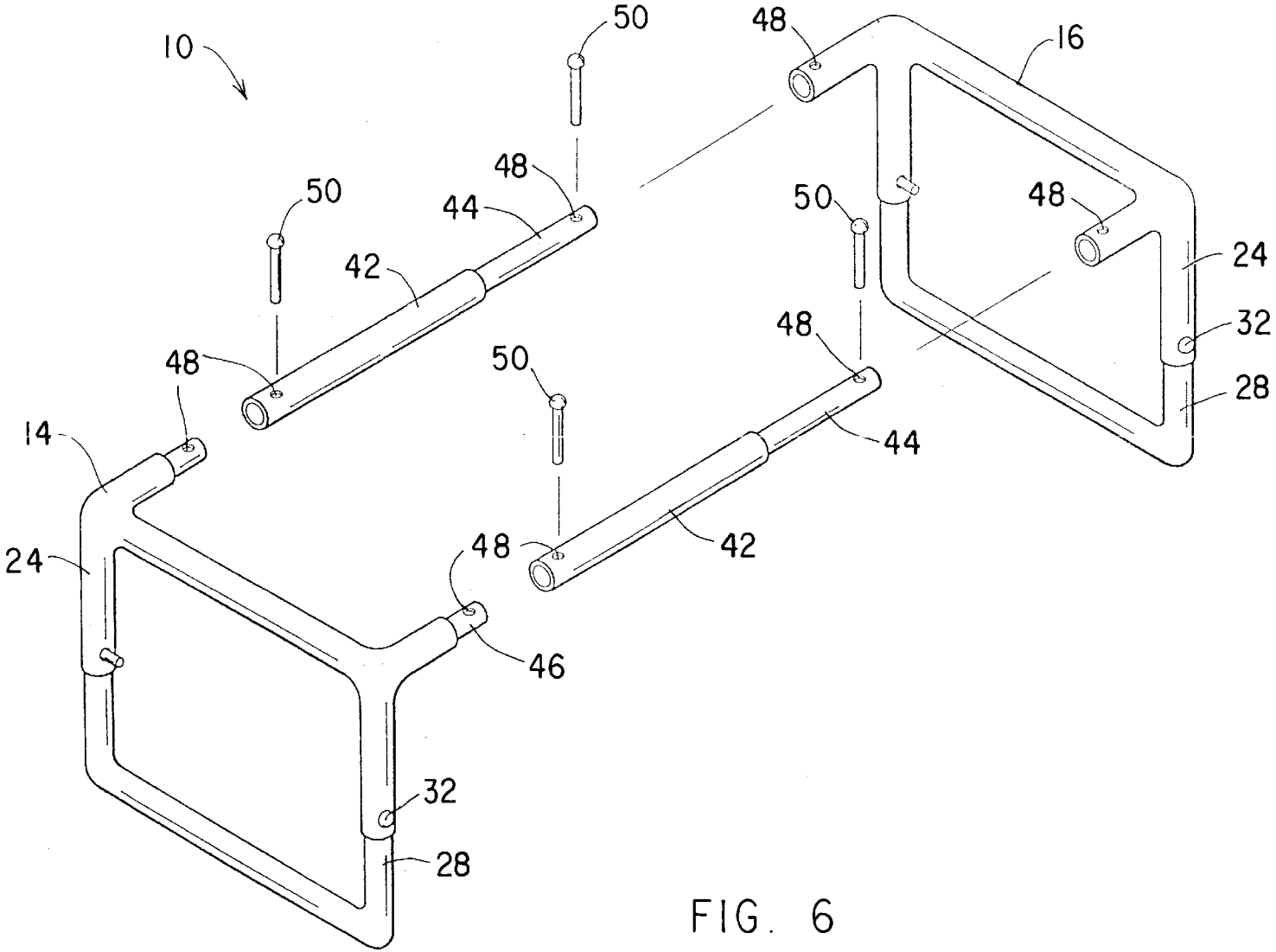
FIG. 6 is a partially exploded view of the components of FIG. 5.

FIGS. 5 and 6 illustrate an alternative embodiment which shows one way this may be done. In the embodiment shown in FIGS. 5 and 6 the arms 14 and 16 have cavities which are equal in diameter. Each of the free ends of first arm 14 have a reduction coupler 46 inserted in the cavity defined in the arm 14, the coupler 46 having an external diameter slightly smaller than the diameter of the cavity and being glued or otherwise fixedly secured to the ends of the arm 14.

The end members 42 of the first arm 14 have a cavity defined therein sized so that the end members 42 telescope over the free ends of the reduction couplers 46. The end members 42 and the reduction couplers 46 have opposing holes 48 defined in the overlapping portions of the end members 42 and reduction couplers 46 aligned so that removable pins 50 may be inserted through opposing holes 48 in order to lock the end members 42 and 46 in a fixed position temporarily.

The end members 44 of the second arm 16 have an external diameter slightly smaller than the diameter of the ends of the second arm 16 so that the end members 44 of the second arm 16 telescope within the cavity defined in the free ends of the second arm 16. The end members 44 of the second arm 16 and the ends of the second arm 16 have opposing holes 48 defined in the overlapping portions of the end members 44 and the ends of the second arm 16 aligned so that removable pins 50 may be inserted through opposing holes 48 in order to lock the end members 44 and the ends of the second arm 16 in a fixed position temporarily.

In all other respects, the embodiment shown in FIGS. 5 and 6 are identical. The end members 44 of the second arm 16 telescope into the end members 42 of the first arm 14 so notches, as shown in FIG. 4, in the end members 44 of the second arm 16 lock in the detent knobs 22 of the end members 42 of the first arm 14 to hold the frame 12 in fixed position. Since the end members 42 and 44 are removable by taking out pins 50, they may be removed as a unit on both sides of the frame and replaced by pairs of shorter or longer end members 42 and 44.

It is to be understood that the present invention is not limited to the sole embodiment described above, but encompasses any and all embodiments within the scope of the following claims.

I claim:

1. A portable adjustable bag holder comprising:

a) a frame, having:

(i) a first arm, the first arm being U-shaped and having a first free end having a cavity defined therein and a second free end having a cavity defined therein, said first free end having a first end member with a cavity defined therein and said second free end having a second end member with a cavity defined therein, the cavity of each end member defining an inner surface of each end member of said first arm; and (ii) a second arm, the second arm being U-shaped and having a third free end and a fourth free end, the third free end having a third end member and the fourth free end having a fourth end member, said third end member being slidably inserted into the cavity defined in said first end member and said fourth end member being slidably inserted into the cavity defined in said second end member, whereby said first arm and said second arm define a plane and a perimeter of said frame, the perimeter being substantially rectangular and having four vertices and the plane being disposed horizontally;

b) a size adjustment means for adjusting the size of the perimeter of said frame, the size adjustment means comprising:

i) a first knob protruding from the inner surface of the first end member of said first arm;

ii) a second knob protruding from the inner surface of the second end member of said first arm; and iii) a plurality of spaced apart notches longitudinally positioned along the third and fourth end members of said second arm, whereby as the third and fourth end members of said second arm are slidably inserted within the cavities defined in the first and second end members of said first arm, said notches engage said first knob and said second knob, in order to hold said first arm and said second arm in a fixed position;

c) a plurality of legs having a first end and a second end, the first end of each of said legs being fixedly attached to said frame at one of the vertices, each of said legs being perpendicular to the plane of the frame and extending vertically downwards, the second end of each of said legs having a cavity defined therein;

d) a plurality of feet slidably moveable in the cavity of the second end of each of said legs; and e) a height adjustment means for adjustably securing said feet to said legs, whereby the height of the frame is adjusted.

2. The portable adjustable bag holder according to claim 1, wherein said height adjustment means includes:

a) said legs having a hole and an opposing hole located adjacent to the second end of said legs;

b) said feet having a plurality of holes and opposing holes longitudinally positioned along said feet;

c) a plurality of removable pins, said feet being slidably inserted within the cavity defined in the second end of said legs, one of said holes and opposing holes in said feet being in registry with a hole and opposing hole in said legs to define aligned holes, said pins being inserted through the aligned holes and locking said legs and said feet in a fixed position; and d) wherein said feet are U-shaped having two free ends, each of said free ends being slidably moveable in the cavity defined in the second end of said legs.

3. The portable adjustable bag holder according to claim 1, wherein the end members of said first arm are integral with the ends of said first arm, and wherein the end members of said second arm are integral with the ends of said second arm.

4. The portable adjustable bag holder according to claim 1, wherein the end members of said first arm are removably attached to the ends of said first arm, and wherein the end members of said second arm are removably attached to the ends of said second arm.

5. The portable adjustable bag holder according to claim 4, wherein said size adjustment means further comprises:

a) a first coupler fixedly attached to the first free end of said first arm and a second coupler fixedly attached to the second free end of said first arm, each of said couplers having a pair of opposing holes adjacent to a free end of the coupler, the free end of each of said first and second couplers being slidable within the cavity of the first and second end members, respectively, of said first arm;

b) wherein said first and second end members of said first arm each have a pair of opposing holes;

c) a plurality of removable pins, the opposing holes in said first and second couplers being in registry with the opposing holes in said first and second end members in order to define aligned holes, said pins being inserted in the aligned holes whereby the end members of said first arm and the said couplers are locked in a fixed position;

d) wherein said third and fourth end members of said second arm each have a pair of opposing holes and are slidably connectable to the third and fourth free ends, respectively, of said second arm, wherein the free ends of said second arm each have a pair of opposing holes; and e) a plurality of removable pins, the opposing holes in said third and fourth end members being in registry with the opposing holes in said third and fourth free ends in order to define aligned holes, said pins being inserted in the aligned holes whereby the end members of said second arm and the free ends of said second arm are locked in a fixed position.

6. The portable adjustable bag holder according to claim 5, wherein said height adjustment means includes:

a) said legs having a hole and an opposing hole located adjacent to the second end of said legs;

b) said feet having a plurality of holes and opposing holes longitudinally positioned along said feet;

c) a plurality of removable pins, said feet being slidably inserted within the cavity defined in the second end of said legs, one of said holes and opposing holes in said feet being in registry with a hole and opposing hole in said legs to define aligned holes, said pins being inserted through the aligned holes and locking said legs and said feet in a fixed position; and d) wherein said feet are U-shaped having two free ends, each said free end being slidably moveable in the cavity defined in the second end of said legs.

7. The portable adjustable bag holder according to claim 1, wherein said height adjustment means includes:

a) said legs having a hole and an opposing hole located adjacent to the second end of said legs;

b) said feet having a plurality of holes and opposing holes longitudinally positioned along said feet; and c) a plurality of removable pins, said feet being slidably inserted within the cavity defined in the second end of said legs, one of said holes and opposing holes in said feet being in registry with a hole and opposing hole in said legs to define aligned holes, said pins being inserted through the aligned holes and locking said legs and said feet in a fixed position.

8. The portable adjustable bag holder according to claim 1 wherein said feet are U-shaped having two free ends, each said free end being slidably moveable in the cavity defined in the second end of said legs.

* * * * *